US011391249B2

(12) United States Patent
Nitu et al.

(10) Patent No.: US 11,391,249 B2
(45) Date of Patent: Jul. 19, 2022

(54) ENGINE SECONDARY AIR AND EGR SYSTEM AND METHOD

(71) Applicants: Bogdan A Nitu, Plymouth, MI (US); Fadi Estefanous, Troy, MI (US); Luron Zhong, Troy, MI (US)

(72) Inventors: Bogdan A Nitu, Plymouth, MI (US); Fadi Estefanous, Troy, MI (US); Luron Zhong, Troy, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 17/070,396

(22) Filed: Oct. 14, 2020

(65) Prior Publication Data

US 2022/0112868 A1 Apr. 14, 2022

(51) Int. Cl.
*F02M 26/06* (2016.01)
*F02M 26/38* (2016.01)
*F02M 26/16* (2016.01)

(52) U.S. Cl.
CPC ..... *F02M 26/06* (2016.02); *F02M 26/16* (2016.02); *F02M 26/38* (2016.02)

(58) Field of Classification Search
CPC ..... F02M 26/06; F02M 26/16; F02M 26/38
USPC ..... 60/605.2, 280, 285, 295; 701/108
See application file for complete search history.

(56) References Cited

U.S. PATENT DOCUMENTS 3,774,399 A * 11/1973 Nohira ..... F02M 26/34 123/568.11
5,271,221 A 12/1993 Lyon
5,845,492 A * 12/1998 Isobe ..... F02M 26/36 60/285
5,974,792 A * 11/1999 Isobe ..... F02B 33/34 60/285
6,971,357 B2 * 12/2005 Grieser ..... F01N 3/30 123/179.18
7,409,823 B2 * 8/2008 Price ..... F01N 3/0842 60/295
8,438,840 B2 * 5/2013 Bidner ..... F02M 26/06 60/295
8,683,786 B2 4/2014 Ruona et al.
8,997,484 B2 * 4/2015 Rollinger ..... F02M 26/36 60/602
9,181,856 B2 11/2015 Grissom et al.
9,279,396 B2 * 3/2016 Rollinger ..... F02M 26/34
9,382,838 B2 * 7/2016 Rollinger ..... F02M 26/10
9,957,876 B2 * 5/2018 Zhang ..... F02M 26/06
10,302,048 B2 5/2019 Zhang
(Continued)

FOREIGN PATENT DOCUMENTS

EP 0574181 A1 12/1993

*Primary Examiner* — Jesse S Bogue
(74) *Attorney, Agent, or Firm* — Ralph E. Smith

(57) ABSTRACT

An internal combustion engine system includes an engine, an air intake system configured to provide intake air to the engine, and an exhaust system configured to receive exhaust gas from the engine. The engine system further includes a secondary air system including a pump, an exhaust gas recirculation (EGR) system, and a valve system operably associated with the secondary air system and the EGR system. The valve system is configured to operate in a secondary air mode where the pump is utilized to supply secondary air to the exhaust system, and an EGR mode where the pump is utilized to supply EGR to the air intake system.

19 Claims, 2 Drawing Sheets

(56) References Cited

U.S. PATENT DOCUMENTS

| | | | | |
|---|---|---|---|---|
| 2003/0154716 | A1* | 8/2003 | Redon | F02M 26/37<br>60/605.2 |
| 2010/0139267 | A1 | 6/2010 | Schliesche et al. | |
| 2011/0072788 | A1* | 3/2011 | Ruona | F02M 26/06<br>60/295 |
| 2013/0305715 | A1* | 11/2013 | Rollinger | F02M 26/06<br>60/605.2 |
| 2014/0060040 | A1* | 3/2014 | Zhang | F01N 3/2066<br>60/274 |
| 2016/0177887 | A1* | 6/2016 | Fischer | F02M 26/15<br>60/605.2 |
| 2016/0348615 | A1* | 12/2016 | Fischer | F02M 35/02 |
| 2019/0316551 | A1* | 10/2019 | Oh | F02M 26/65 |
| 2020/0408141 | A1* | 12/2020 | Kreutziger | F01N 3/035 |

* cited by examiner

ENGINE SECONDARY AIR AND EGR SYSTEM AND METHOD

FIELD

The present application relates generally to secondary air and exhaust gas recirculation (EGR) systems for internal combustion engines and, more particularly, to an internal combustion engine having a single pump and valve system to drive secondary air, EGR, and boost air to improve engine transient acceleration.

BACKGROUND

Secondary air systems are typically utilized in vehicles during engine cold start operations to add oxygen to exhaust gases. Because the engine is cold, exhaust emissions tend to be high. To reduce warm up time, the engine is operated with a richer air-to-fuel ratio and mixed with the secondary air. Once the exhaust system is at operational temperature, the secondary air system is shut down.

Additionally, vehicles typically include an exhaust gas recirculation (EGR) system, which recirculates a portion of engine exhaust gas back to the air intake to reduce emissions. The EGR is driven by the pressure difference between the exhaust system point of EGR extraction and the intake system point of EGR insertion. Typically, the insertion point is immediately after the throttle to take advantage of the lower pressure created when the throttle is partially open. However, the greater the opening of the throttle, the less lower pressure is created after the throttle thus potentially resulting in lowered EGR driving capability. Therefore, while such systems work well for their intended purpose, it is desirable to provide continuous improvement in the relevant art.

SUMMARY

In accordance with one example aspect of the invention, an internal combustion engine system is provided. In one example implementation, the system includes an engine, an air intake system configured to provide intake air to the engine, and an exhaust system configured to receive exhaust gas from the engine. The engine system further includes a secondary air system including a pump, an exhaust gas recirculation (EGR) system, and a valve system operably associated with the secondary air system and the EGR system. The valve system is configured to operate in a secondary air mode where the pump is utilized to supply secondary air to the exhaust system, and an EGR mode where the pump is utilized to supply EGR to the air intake system.

In addition to the foregoing, the described engine system may include one or more of the following features: wherein in the secondary air mode, the pump is utilized to supply secondary air to the exhaust system while EGR is prevented from being supplied to the air intake system; wherein in the EGR mode, the pump is utilized to supply EGR to the air intake system while secondary air is prevented from being supplied to the exhaust system; wherein in the EGR mode, the pump is utilized to supply EGR to the air intake system without relying on a lower pressure behind a throttle of the intake air system; and wherein in the EGR mode, the pump is utilized to supply EGR to the air intake system when a throttle of the intake air system is substantially closed.

In addition to the foregoing, the described engine system may include one or more of the following features: wherein the valve system is configured to further operate in a boost mode where the pump is utilized to provide boost air to the air intake system through both a portion of the secondary air system and a portion of the EGR system; wherein the valve system includes a first three-way valve; wherein the valve system further includes a second three-way valve; and wherein the secondary air system further includes a secondary air intake conduit coupled between the air intake system and the valve system, and a secondary air supply conduit coupled between the valve system and the exhaust system.

In addition to the foregoing, the described engine system may include one or more of the following features: wherein the EGR system includes an EGR intake conduit coupled between the exhaust system and the valve system, and an EGR supply conduit coupled between the valve system and the intake air system; a turbocharger assembly having a compressor and a turbine; and wherein the valve system includes a first three-way valve and a second three-way valve, wherein the secondary air system further includes a secondary air intake conduit coupled between the air intake system and the second three-way valve, and a secondary air supply conduit coupled between the first three-way valve and the exhaust system, and wherein the EGR system includes an EGR intake conduit coupled between the exhaust system and the second three-way valve, and an EGR supply conduit coupled between the first three-way valve and the intake air system.

In addition to the foregoing, the described engine system may include one or more of the following features: a connecting conduit coupled between the first and second three-way valves; wherein the pump is disposed on the connecting conduit between the first and second three-way valves and configured to selectively draw secondary air through the secondary air intake conduit or the EGR intake conduit; and wherein in the secondary air mode, the pump is utilized to supply secondary air to the exhaust system while EGR is prevented from being supplied to the air intake system, and wherein in the EGR mode, the pump is utilized to supply EGR to the air intake system while secondary air is prevented from being supplied to the exhaust system.

In accordance with another example aspect of the invention, a method is provided for selectively providing secondary air and exhaust gas recirculation (EGR) in an internal combustion engine system having an air intake system and an exhaust system by utilizing a single pump and a valve system operably coupled to a secondary air system and an EGR system. In one example implementation, the method includes operating in a secondary air mode by moving the valve system to a position allowing secondary airflow to the valve system and preventing EGR flow to the valve system, and operating the single pump to supply secondary air through the secondary air system to the exhaust system. The method further includes operating in an EGR mode by moving the valve system to a position allowing EGR flow to the valve system and preventing secondary air flow to the valve system, and operating the single pump to supply EGR through the EGR system to the intake air system.

In addition to the foregoing, the described method may include one or more of the following features: operating a boost mode by moving the valve system to a position allowing secondary airflow to the valve system and preventing EGR flow to the valve system, further moving the valve system to a position allowing the secondary airflow to flow through a portion of the EGR system to the air intake system, and operating the single pump to supply boost air through a portion of the secondary air system and the portion of the EGR system to the air intake system.

In addition to the foregoing, the described method may include one or more of the following features: wherein the step of moving the valve system to a position allowing secondary airflow to the valve system and preventing EGR flow to the valve system comprises moving a first three-way valve to a position allowing secondary airflow to flow to the exhaust system, and moving a second three-way valve to a position allowing secondary airflow through the second three-way valve and preventing EGR flow through the second three-way valve; and wherein the step of moving the valve system to a position allowing EGR flow to the valve system and preventing secondary air flow to the valve system comprises moving a first three-way valve to a position allowing EGR flow to flow to the intake system, and moving a second three-way valve to a position allowing EGR flow through the second three-way valve and preventing secondary airflow through the second three-way valve.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

Described herein are systems and methods utilizing a single pump to drive EGR, drive secondary air to mitigate engine out emissions, and drive boost air to improve transient acceleration of an internal combustion engine. The systems include dual three-way valves to selectively switch between driving secondary air, EGR, and boost air to improve vehicle and engine performance. When utilized for EGR, the driving capability no longer relies on the lower pressure behind the throttle, thus enabling EGR when the throttle fully open or substantially fully open. This extended EGR usage range allows for the use of EGR to reduce knock sensibility in engine operating points where the throttle is open or substantially open, thereby reducing fuel consumption by allowing the spark to be advanced. When utilized engine boost (e.g., improved acceleration), the pump increases air flow at engine intake thereby boosting the charge and allowing for more fuel to be injected and reducing the time for engine response.

Figure 1:
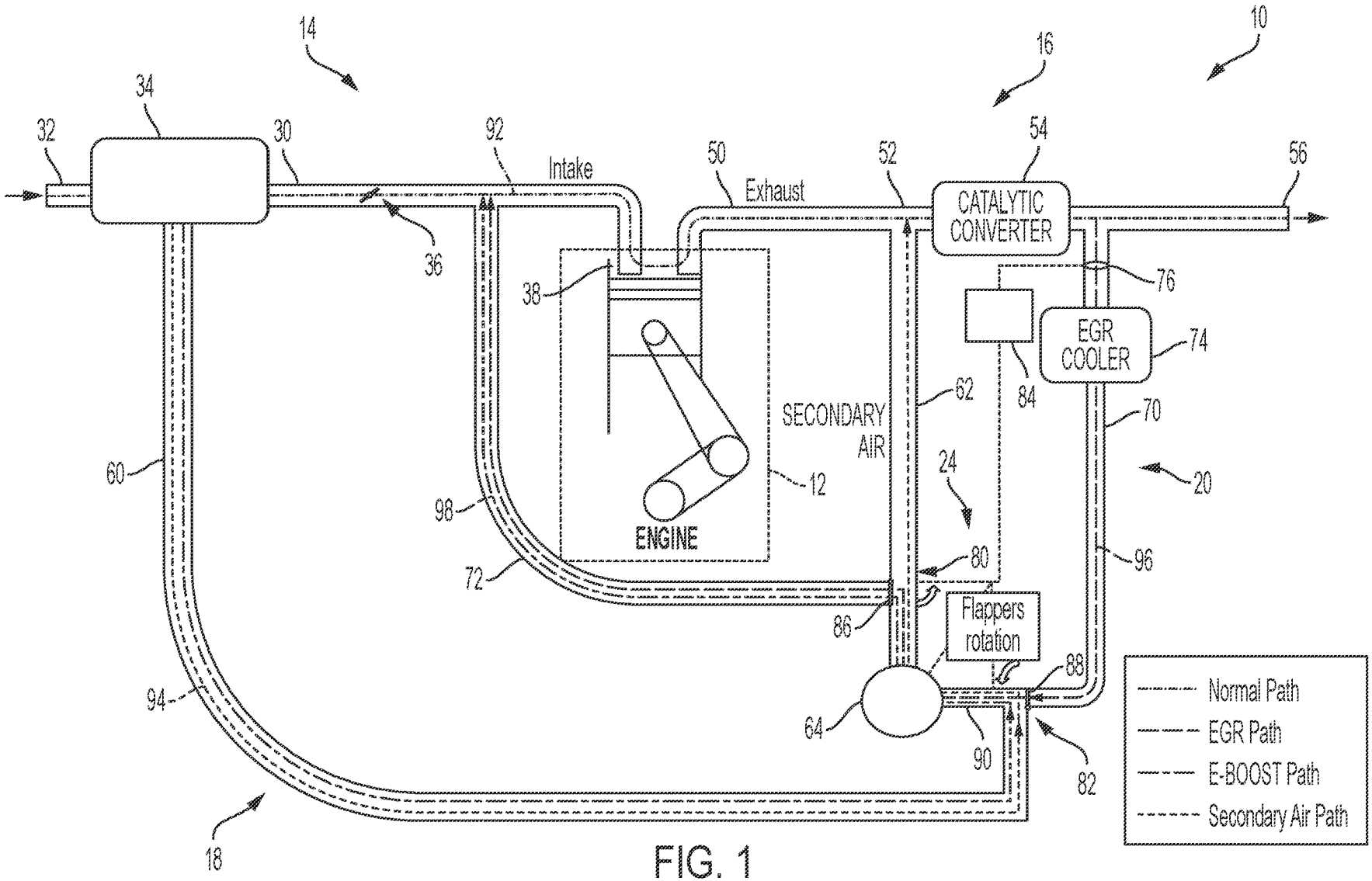
FIG. 1 is a schematic illustration of an example naturally aspirated engine with secondary air and EGR systems, in accordance with the principles of the present application.

With initial reference to FIG. 1, an example naturally aspirated engine system is illustrated and generally identified at reference numeral 10. In the example embodiment, naturally aspirated engine system 10 generally includes an engine 12, an air intake system 14, an exhaust system 16, a secondary air system 18, and an exhaust gas recirculation (EGR) system 20. As described herein in more detail, the engine system 10 further includes a valve system 24 configured to selectively drive secondary air, EGR, and boost air to improve vehicle performance and capability.

With continued reference to FIG. 1, the air intake system 14 includes an air intake conduit 30 having an air inlet 32 configured to receive fresh or recirculated air, an air filter 34, and a throttle 36. Air intake conduit 30 is fluidly coupled to engine 12, and the throttle 36 is configured to selectively move between open and closed positions to regulate the amount of air and/or fuel supplied to cylinders 38 of the engine 12. The exhaust system 16 includes an exhaust manifold 50 configured to supply an exhaust gas from the cylinders 38 to an exhaust gas conduit 52. One or more exhaust gas aftertreatment components 54, such as a catalytic converter, are disposed within exhaust gas conduit 52 to treat the exhaust gas. The treated exhaust gas is then directed to the EGR system 20 or exhaust to the atmosphere via exhaust gas outlet 56.

In the example embodiment, the secondary air system 18 generally includes a secondary air intake conduit 60, a secondary air supply conduit 62, and a secondary air pump 64. The secondary air pump 64 is configured to supply secondary air via the secondary air supply conduit 62 to a location in the exhaust gas conduit 52 upstream of the aftertreatment component(s) 54.

In the illustrated example, the EGR system 20 generally includes an EGR intake conduit 70, an EGR supply conduit 72, and an EGR cooler 74. An optional EGR valve 76 is configured to control the flow of exhaust gas into the EGR intake conduit 70 where the EGR flow is subsequently cooled within the EGR cooler 74. The cooled EGR flow is then directed via the EGR supply conduit 72 to a location on the air intake conduit 30 upstream of the engine 12 for supplying the EGR flow thereto. In the illustrated example, the EGR supply conduit 72 is fluidly coupled to the air intake conduit 30 at a location downstream of the throttle 36 and upstream of the engine 12. However, it will be appreciated that EGR supply conduit 72 may be coupled to the air intake conduit 30 in various locations such as, for example, upstream of the throttle 36 and downstream of the air filter 34.

In the example embodiment, the valve system 24 generally includes a first three-way valve 80 and a second three-way valve 82 in signal communication with a controller 84, which may also be in signal communication with throttle 36, pump 64, and/or EGR valve 76. The first three-way valve 80 includes a rotatable flapper 86 configured to selectively seal air flow through one of the secondary air supply conduit 62 and the EGR supply conduit 72. The second three-way valve 82 includes a rotatable flapper 88 configured to selectively seal flow from one of the secondary air intake conduits 60 and the EGR intake conduit 70. As shown in FIG. 1, a connecting conduit 90 is fluidly coupled between an outlet of the second valve 82 and an inlet of the first valve 80. In the illustrated example, the pump 64 is disposed on the connecting conduit 90 between the first and second valves 80, 82. Although described as flapper-type valves, it will be appreciated that valves 80 and 82 may be any suitable type of valve that enables system 10 to function as described herein.

In one example operation, controller 84 is configured to operate naturally aspirated engine system 10 in (i) a normal mode, (ii) a secondary air mode, (iii) an EGR mode, and (iv) a boost mode. As shown in FIG. 1, operation in (i) normal mode produces an air/exhaust flow shown by line 92, operation in (ii) secondary air mode produces an air/exhaust flow shown by line 94, operation in (iii) EGR mode produces an air/exhaust flow shown by line 96, and operation in (iv) boost mode produces an air/exhaust flow shown by line 98.

In the example (i) normal mode operation, controller 84 is programmed to turn secondary air pump 64 off and valve 80 to close path 72 and valve 88 to close path 70. In this configuration, shown by line 92, air enters air intake conduit 30 via air inlet 32 and is directed to the engine 12 where it is mixed with fuel and combusted in cylinders 38. The resulting exhaust gas is directed through the exhaust manifold 50 and exhaust gas conduit 52 to the exhaust gas outlet 56.

In the example (ii) secondary air mode operation, for example during a cold start, controller 84 is programmed to operate first valve 80 to move flapper 86 to prevent flow into EGR supply conduit 72, and operate second valve 82 to move flapper 88 to prevent flow from EGR intake conduit 70. Controller 84 then turns on pump 64, which as shown by line 94, draws additional airflow into secondary air intake conduit 60, through pump 64, and subsequently through secondary air supply conduit 62. In this way, secondary air is supplied to the exhaust system 16.

In the example (iii) EGR mode operation, controller 84 is programmed to operate first valve 80 to move flapper 86 to prevent flow into secondary air supply conduit 62, and operate second valve 82 to move flapper 88 to prevent flow from secondary air supply conduit 62. Controller 84 then turns on pump 64, which as shown by line 96, draws EGR into the EGR intake conduit 70, through pump 64, and subsequently through EGR supply conduit 72. Additionally, controller 84 may control the opening of EGR valve 76 to further vary the EGR flow into the EGR intake conduit 70. In this way, EGR is supplied to the intake air system 14 for subsequent re-combustion in cylinders 38.

In the example (iv) boost mode operation, controller 84 is programmed to operate first valve 80 to move flapper 86 to prevent flow into secondary air supply conduit 62, and operate second valve 82 to move flapper 88 to prevent flow from EGR intake conduit 70. Controller 84 then turns on pump 64, which as shown by line 98, draws air into the secondary air intake conduit 60, through pump 64, and subsequently through EGR supply conduit 72. In this way, boost air is supplied to the intake air system 14 to increase air flow at engine intake, thereby boosting the charge and allowing for more fuel to be injected and reducing the time for engine response.

Figure 2:
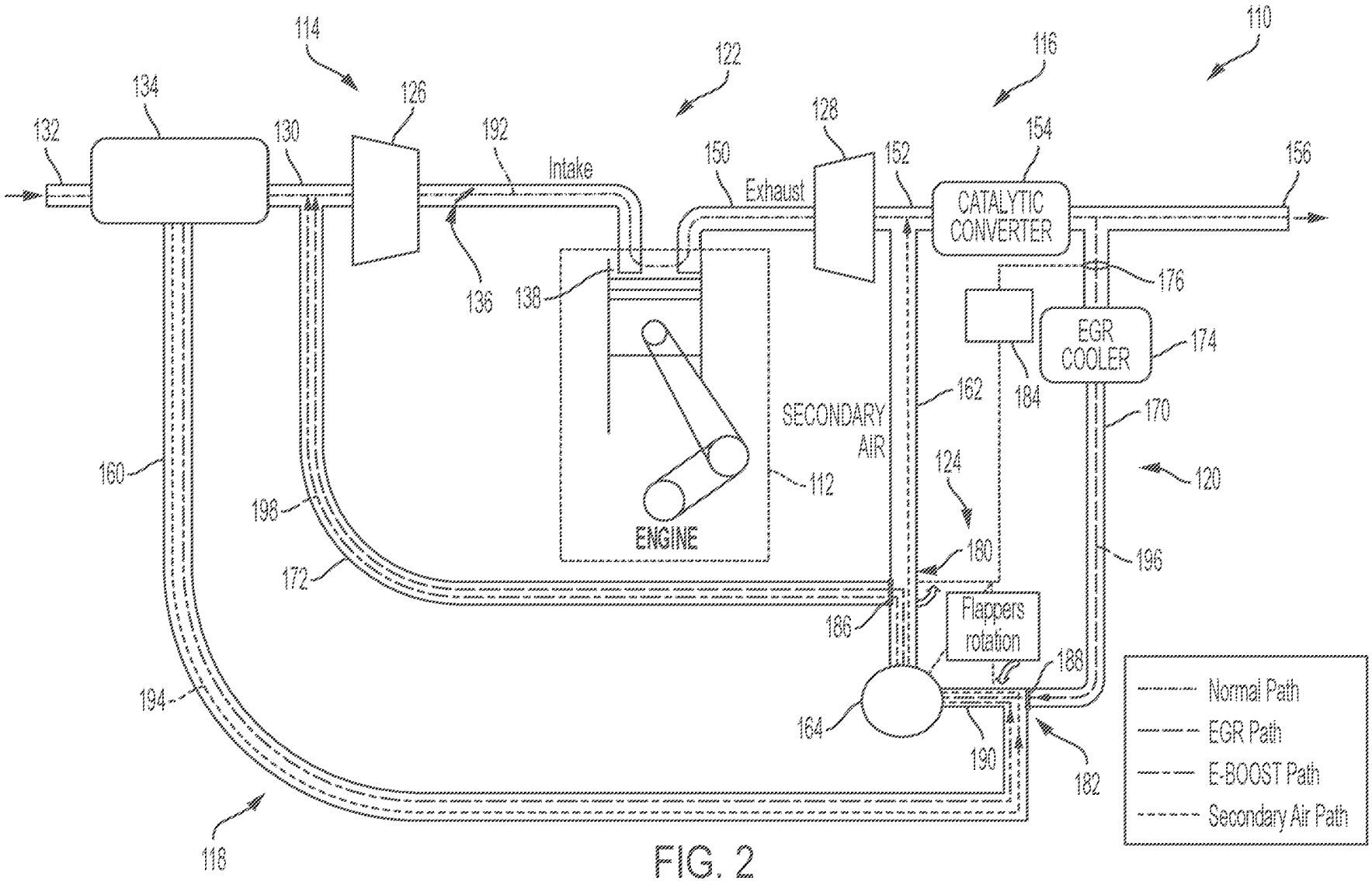
FIG. 2 is a schematic illustration of an example charged engine with secondary air and EGR systems, in accordance with the principles of the present application.

With reference now to FIG. 2, an example turbocharged engine system is illustrated and generally identified at reference numeral 110. In the example embodiment, turbocharged engine system 110 generally includes an engine 112, an air intake system 114, an exhaust system 116, a secondary air system 118, an EGR system 120, and a turbocharger assembly 122.

As illustrated, turbocharger assembly 122 generally includes a compressor 126, which is rotatably coupled to a turbine 128 via a shaft (not shown). The compressor 126 is configured to compress intake air and includes an inlet configured to receive ambient air, and an outlet in fluid communication with the vehicle engine 112. The turbine 128 is configured to utilize exhaust gas to rotate the compressor 126 and includes an exhaust inlet configured to receive exhaust gas from the engine 112, and an exhaust outlet fluidly coupled to the exhaust system 116.

Similar to engine system 10, the turbocharged engine system 110 includes a valve system 124 configured to selectively drive secondary air, EGR, and boost air to improve vehicle performance and capability. It will be appreciated, however, that the described secondary air systems, EGR systems, and valve systems may be utilized with other types of engine systems such as, for example, a supercharged engine system.

With continued reference to FIG. 2, the air intake system 114 generally includes an air intake conduit 130 having an air inlet 132 configured to receive fresh or recirculated air, an air filter 134, and a throttle 136. Air intake conduit 130 is fluidly coupled to engine 112 via the compressor 126, and the throttle 136 is configured to selectively move between open and closed positions to regulate the amount of air and/or fuel supplied to engine cylinders 138. The exhaust system 116 includes an exhaust manifold 150 configured to supply an exhaust gas from the cylinders 138 to the turbine 128 and subsequently to an exhaust gas conduit 152. One or more exhaust gas aftertreatment components 154 are disposed within exhaust gas conduit 152 to treat the exhaust gas. The treated exhaust gas is then directed to the EGR system 120 or exhausted to the atmosphere via exhaust gas outlet 156.

In the example embodiment, the secondary air system 118 generally includes a secondary air intake conduit 160, a secondary air supply conduit 162, and a secondary air pump 164. The secondary air pump 164 is configured to supply secondary air via the secondary air supply conduit 162 to a location in the exhaust gas conduit 152 upstream of the aftertreatment component(s) 154 and downstream of the turbine 128.

In the illustrated example, the EGR system 120 generally includes an EGR intake conduit 170, an EGR supply conduit 172, and an EGR cooler 174. An optional EGR valve 176 is configured to control the flow of exhaust gas into the EGR intake conduit 170 where the EGR flow is subsequently cooled within the EGR cooler 174. The cooled EGR flow is then directed via the EGR supply conduit 172 to a location on the air intake conduit 130 upstream of the engine 112 for supplying the EGR flow thereto. In the illustrated example, the EGR supply conduit 172 is fluidly coupled to the air intake conduit 130 at a location upstream of the compressor 126. However, it will be appreciated that EGR supply conduit 172 may be coupled to the air intake conduit 130 in various locations.

In the example embodiment, the valve system 124 generally includes a first three-way valve 180 and a second three-way valve 182 in signal communication with a controller 184, which may also be in signal communication with throttle 136, pump 164, and/or EGR valve 176. The first three-way valve 180 includes a rotatable flapper 186 configured to selectively seal air flow through one of the secondary air supply conduits 162 and the EGR supply conduit 172. The second three-way valve 182 includes a rotatable flapper 188 configured to selectively enable flow from one of the secondary air intake conduits 160 and the EGR intake conduit 170 by sealing off the other of the two. A connecting conduit 190 is fluidly coupled between an outlet of the second valve 182 and an inlet of the first valve 180. In the illustrated example, the pump 164 is disposed on the connecting conduit 190 between the first and second valves 180, 182. Although described as flapper-type valves, it will be appreciated that valves 180 and 182 may be any suitable type of valve that enables system 10 to function as described herein.

In one example operation, controller 184 is configured to operate turbocharged engine system 110 in (i) a normal mode, (ii) a secondary air mode, (iii) an EGR mode, and (iv) a boost mode. As shown in FIG. 2, operation in (i) normal mode produces an air/exhaust flow shown by line 192, operation in (ii) secondary air mode produces an air/exhaust flow shown by line 194, operation in (iii) EGR mode produces an air/exhaust flow shown by line 196, and operation in (iv) boost mode produces an air/exhaust flow shown by line 198.

In the example (i) normal mode operation, controller 184 is programmed to turn secondary air pump 164 off and valve 80 to close path 72 and valve 88 to close path 70. In this configuration, as shown by line 192, air enters air intake conduit 130 via air inlet 132 and is directed to the compressor 126 where the air is compressed (charged). The compressed air is subsequently directed to the engine 112 where it is mixed with fuel and combusted in cylinders 138. The resulting exhaust gas is directed through the exhaust manifold 150 to the turbine 128 where it is utilized to transfer rotatable motion to the compressor 126 for compressing intake air. The exhaust gas is then directed via exhaust gas conduit 152 to the exhaust gas outlet 156 and atmosphere.

In the example (ii) secondary air mode operation, for example during a cold start, controller 184 is programmed to operate first valve 180 to move flapper 186 to prevent flow into EGR supply conduit 172, and operate second valve 182 to move flapper 188 to prevent flow from EGR intake conduit 170. Controller 184 then turns on pump 164, which as shown by line 194, draws additional airflow into secondary air intake conduit 160, through pump 164, and subsequently through secondary air supply conduit 162. In this way, secondary air is supplied to the exhaust system 116, for example, in a location downstream of the turbine 128.

In the example (iii) EGR mode operation, controller 184 is programmed to operate first valve 180 to move flapper 186 to prevent flow into secondary air supply conduit 162, and operate second valve 182 to move flapper 188 to prevent flow from secondary air supply conduit 162. Controller 184 then turns on pump 164, which as shown by line 196, draws EGR into the EGR intake conduit 170, through pump 164, and subsequently through EGR supply conduit 172. Additionally, controller 184 may control the opening of EGR valve 176 to further vary the EGR flow into the EGR intake conduit 170. In this way, EGR is supplied to the intake air system 114 to a location upstream of compressor 126 for subsequent re-compression and re-combustion in cylinders 138.

In the example (iv) boost mode operation, controller 184 is programmed to operate first valve 180 to move flapper 186 to prevent flow into secondary air supply conduit 162, and operate second valve 182 to move flapper 188 to prevent flow from EGR intake conduit 170. Controller 184 then turns on pump 164, which as shown by line 198, draws air into the secondary air intake conduit 160, through pump 164, and subsequently through EGR supply conduit 172 to a location upstream of compressor 126. In this way, boost air is supplied to the intake air system 114 to increase air flow at engine intake, thereby boosting the charge and allowing for more fuel to be injected and reducing the time for engine response.

Described herein are systems and methods utilizing a single pump to drive EGR, drive secondary air to mitigate engine out emissions, and drive boost air to improve transient acceleration of an internal combustion engine. The systems include dual three-way valves to selectively the drive secondary air and EGR to improve vehicle and engine performance. Advantageously, the EGR driving capability is decoupled from the pressure difference created by the throttle movement. Thus, utilizing the pump, EGR can be used independently of the pressure difference and the EGR usage range can be extended outside of typical boundaries, thereby reducing fuel consumption by reducing knock tendency and advancing spark timing.

As used herein, the term controller or module refers to an application specific integrated circuit (ASIC), an electronic circuit, a processor (shared, dedicated, or group) and memory that executes one or more software or firmware programs, a combinational logic circuit, and/or other suitable components that provide the described functionality.

It will be understood that the mixing and matching of features, elements, methodologies, systems and/or functions between various examples may be expressly contemplated herein so that one skilled in the art will appreciate from the present teachings that features, elements, systems and/or functions of one example may be incorporated into another example as appropriate, unless described otherwise above. It will also be understood that the description, including disclosed examples and drawings, is merely exemplary in nature intended for purposes of illustration only and is not intended to limit the scope of the present disclosure, its application or uses. Thus, variations that do not depart from the gist of the present disclosure are intended to be within the scope of the present disclosure.

What is claimed is:

1. An internal combustion engine system comprising:
- an engine having at least one cylinder;
- an air intake system configured to provide intake air to the engine;
- an exhaust system configured to receive exhaust gas from the engine;
- a secondary air system including a single pump;
- an exhaust gas recirculation (EGR) system; and
- a valve system operably associated with the secondary air system and the EGR system, wherein the valve system is configured to operate in:
  - a secondary air mode where the single pump is utilized to supply secondary air to the exhaust system; and
  - an EGR mode where the single pump is utilized to supply EGR to the air intake system; wherein the internal combustion engine system is naturally aspirated.

2. The engine system of claim 1, wherein in the secondary air mode, the pump is utilized to supply secondary air to the exhaust system while EGR is prevented from being supplied to the air intake system.

3. The engine system of claim 1, wherein in the EGR mode, the pump is utilized to supply EGR to the air intake system while secondary air is prevented from being supplied to the exhaust system.

4. The engine system of claim 1, wherein in the EGR mode, the pump is utilized to supply EGR to the air intake system without relying on a lower pressure behind a throttle of the intake air system.

5. The engine system of claim 1, wherein in the EGR mode, the pump is utilized to supply EGR to the air intake system when a throttle of the intake air system is substantially closed.

6. The engine system of claim 1, wherein the valve system is configured to further operate in a boost mode where the pump is utilized to provide boost air to the air intake system through both a portion of the secondary air system and a portion of the EGR system.

7. The engine system of claim 1, wherein the valve system includes a first three-way valve.

8. The engine system of claim 7, wherein the valve system further includes a second three-way valve.

9. The engine system of claim 1, wherein the secondary air system further includes:

a secondary air intake conduit coupled between the air intake system and the valve system; and a secondary air supply conduit coupled between the valve system and the exhaust system.

10. The engine system of claim 1, wherein the EGR system includes:

an EGR intake conduit coupled between the exhaust system and the valve system; and an EGR supply conduit coupled between the valve system and the intake air system.

11. An internal combustion engine system comprising: an engine having at least one cylinder; an air intake system configured to provide intake air to the engine; an exhaust system configured to receive exhaust gas from the engine; a secondary air system including a single pump; an exhaust gas recirculation (EGR) system; and a valve system operably associated with the secondary air system and the EGR system, wherein the valve system is configured to operate in: a secondary air mode where the single pump is utilized to supply secondary aft to the exhaust system; and an EGR mode where the single pump is utilized to supply EGR to the air intake system; and further comprising a turbocharger assembly having a compressor and a turbine.

12. The engine system of claim 1, wherein the valve system includes a first three-way valve and a second three-way valve; wherein the secondary air system further includes a secondary air intake conduit coupled between the air intake system and the second three-way valve, and a secondary air supply conduit coupled between the first three-way valve and the exhaust system; and wherein the EGR system includes an EGR intake conduit coupled between the exhaust system and the second three-way valve, and an EGR supply conduit coupled between the first three-way valve and the intake air system.

13. The engine system of claim 12, further comprising a connecting conduit coupled between the first and second three-way valves.

14. The engine system of claim 13, wherein the pump is disposed on the connecting conduit between the first and second three-way valves and configured to selectively draw secondary air through the secondary air intake conduit or the EGR intake conduit.

15. The engine system of claim 1, wherein in the secondary air mode, the pump is utilized to supply secondary air to the exhaust system while EGR is prevented from being supplied to the air intake system, and wherein in the EGR mode, the pump is utilized to supply EGR to the air intake system while secondary air is prevented from being supplied to the exhaust system.

16. A method of selectively providing secondary air and exhaust gas recirculation (EGR) in an internal combustion engine system having an air intake system and an exhaust system by utilizing a single pump and a valve system operably coupled to a secondary air system and an EGR system, the method comprising:

operating in a secondary air mode by:

moving the valve system to a position allowing secondary airflow to the valve system and preventing EGR flow to the valve system; and operating the single pump to supply secondary air through the secondary air system to the exhaust system; and operating in an EGR mode by:

moving the valve system to a position allowing EGR flow to the valve system and preventing secondary air flow to the valve system; and operating the single pump to supply EGR through the EGR system to the intake air system.

17. The method of claim 16, further comprising operating a boost mode by:

moving the valve system to a position allowing secondary airflow to the valve system and preventing EGR flow to the valve system;

further moving the valve system to a position allowing the secondary airflow to flow through a portion of the EGR system to the air intake system; and operating the single pump to supply boost air through a portion of the secondary air system and the portion of the EGR system to the air intake system.

18. The method of claim 16, wherein the step of moving the valve system to a position allowing secondary airflow to the valve system and preventing EGR flow to the valve system comprises:

moving a first three-way valve to a position allowing secondary airflow to flow to the exhaust system; and moving a second three-way valve to a position allowing secondary airflow through the second three-way valve and preventing EGR flow through the second three-way valve.

19. The method of claim 16, wherein the step of moving the valve system to a position allowing EGR flow to the valve system and preventing secondary air flow to the valve system comprises:

moving a first three-way valve to a position allowing EGR flow to flow to the intake system; and moving a second three-way valve to a position allowing EGR flow through the second three-way valve and preventing secondary airflow through the second three-way valve.

* * * * *